US006719590B1

(12) United States Patent
Wu

(10) Patent No.: US 6,719,590 B1
(45) Date of Patent: Apr. 13, 2004

(54) ELECTRICAL ADAPTER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/278,426

(22) Filed: Oct. 22, 2002

(51) Int. Cl.[7] ..... H01R 25/00
(52) U.S. Cl. ..... 439/638
(58) Field of Search ..... 439/108, 84, 631, 439/638, 650, 651, 654, 655, 653, 862, 874

(56) References Cited

U.S. PATENT DOCUMENTS 5,454,737 A * 10/1995 Saba ..... 439/655
5,456,620 A * 10/1995 Kaminski ..... 439/654
5,725,400 A * 3/1998 Morikawa et al. ..... 439/874
6,257,740 B1 * 7/2001 Gibboney, Jr. ..... 362/288
6,511,349 B2 * 1/2003 Ishikawa et al. ..... 439/631

* cited by examiner

*Primary Examiner*—Javaid H. Nasri
*Assistant Examiner*—Thanh-Tam Le
(74) *Attorney, Agent, or Firm*—Wei Te Chung

(57) ABSTRACT

An electrical adapter (1) includes a first connector portion (10), a second connector portion (20) having a different type from the first connector portion, and a plurality of flexible wires (30) electrically connecting the first and second connector portions with each other. The first connector portion includes a first dielectric housing (12) and a plurality of first power contacts (19) retained to the first dielectric housing. The second connector portion includes a second dielectric housing (22) and a plurality of second power contacts (24) retained to the second dielectric housing. Each flexible wire has two opposite ends (32, 34) electrically connected to the first and second power contacts, respectively.

9 Claims, 13 Drawing Sheets

ELECTRICAL ADAPTER

CROSS-REFERENCE TO RELATED APPLICATION

This application is a co-pending application of U.S. patent application Ser. No. 10/269,207 filed on Oct. 11, 2002 and entitled "POWER ADAPTER FOR INTERCONNECTING DIFFERENT TYPES OF POWER CONNECTORS", invented by the same inventor, and assigned to the same assignee. The disclosure of the co-pending application is wholly incorporated herein by reference.

BACKGROUND OF THE INVENTION

1. Field of the Invention

The present invention relates to an electrical adapter, and particularly to an electrical adapter which provides flexible wires to electrically connect two connector portions thereof with each other.

2. Description of Related Art

The design of a mother printed circuit board is repeatedly upgraded for complying with an issuance of each new electrical member to be mounted thereon. Some peripheral electrical devices such as a power supply and the related power connector must also be adapted to accommodate the new type of printed circuit board. Therefore, various different interface standard power connectors are continually proposed to be applied in a computer interior structure. However, such power connectors according different interface standard are generally featured in different configurations and each has different numbers electrical contacts therein. Understandably, such different interface standard power connectors cannot mate directly. Many electrical adapters, thereby, are designed to interconnect those different interface standard connectors.

Generally, the electrical adapter electrically interconnecting with different interface standard connectors performs the functions of signal/power transmission and conversion therebetween by two ways. If the numbers of electrical contacts of the different interface connector are equal, the adapter may mechanically and electrically connect corresponding contacts directly. In the other hand, the adapter need comprise a printed circuit board thereof which can perform the functions of signal/power transmission and conversion if the numbers of the different standard connectors are different. Obviously, the adapter having a printed circuit board would add expense relative to the adapter directly interconnecting the different interface standard.

There also exists in the art an electrical connector known as a Serial Advanced Technology Attachment (Serial ATA) connector which is generally used for disk drives and storage peripherals connecting with the mother printed circuit board. It should be noted that the Serial ATA power connectors according the Serial ATA standard are in added power contacts than other conventional power connectors used in Integrated Drive Electronics (IDE) and are relatively different in configurations. Correspondingly, the present problem people in the art confronts, is that a storage peripheral using a Serial ATA power connector may be required to connect with an existing mother printed circuit board which originally uses a conventional IDE power connector to connect with the storage peripheral, for the speed or other considerations. Under this situation, it is not convenient to wholly replace the system, which adds cost. Accordingly, a power adapter interconnecting the Serial ATA power connector and the conventional IDE power connector is desired.

Furthermore, the power adapter without printed circuit board is required to save cost.

Hence, a power adapter for interconnecting the power connectors of different interface standard is required to overcome the disadvantages of the related art.

BRIEF SUMMARY OF THE INVENTION

Accordingly, a first object of the present invention is to provide an electrical adapter which provides flexible wires to electrically connect two connector portions thereof together with each other.

A second object of the present invention is to provide a power adapter for electrically interconnecting two different types of power connectors with each other.

To fulfill the above-mentioned objects, an electrical adapter in accordance with the present invention includes a first connector portion, a second connector portion having a different type from the first connector portion, and a plurality of flexible wires electrically connecting the first and second connector portions with each other. The first connector portion includes a first dielectric housing and a plurality of first power contacts retained to the first dielectric housing. The second connector portion includes a second dielectric housing and a plurality of second power contacts retained to the second dielectric housing. Each flexible wire has two opposite ends electrically connected to the first and second power contacts, respectively.

Other objects, advantages and novel features of the invention will become more apparent from the following detailed description of the present embodiment when taken in conjunction with the accompanying drawings.

DETAILED DESCRIPTION OF THE INVENTION

Figure 1:
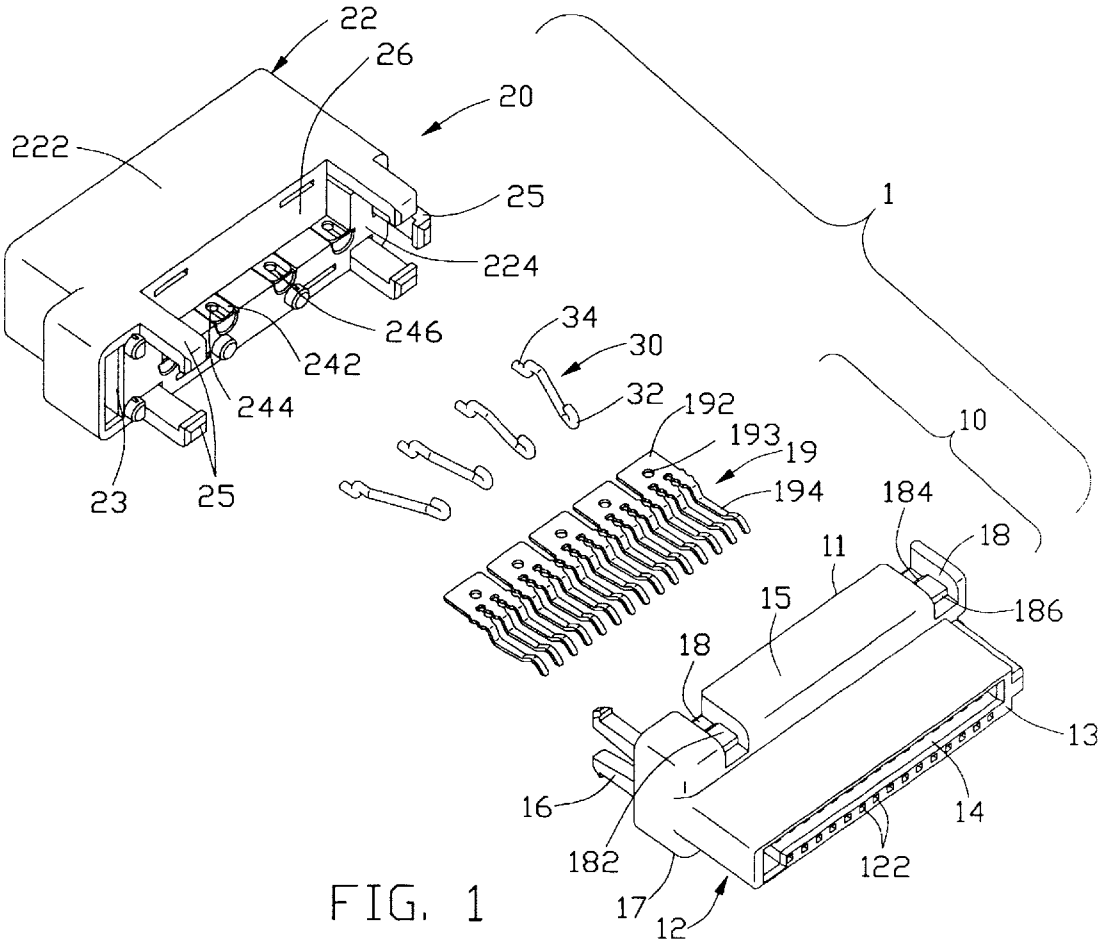
FIG. 1 is an exploded view of an electrical adapter in accordance with the present invention.
Figure 2:
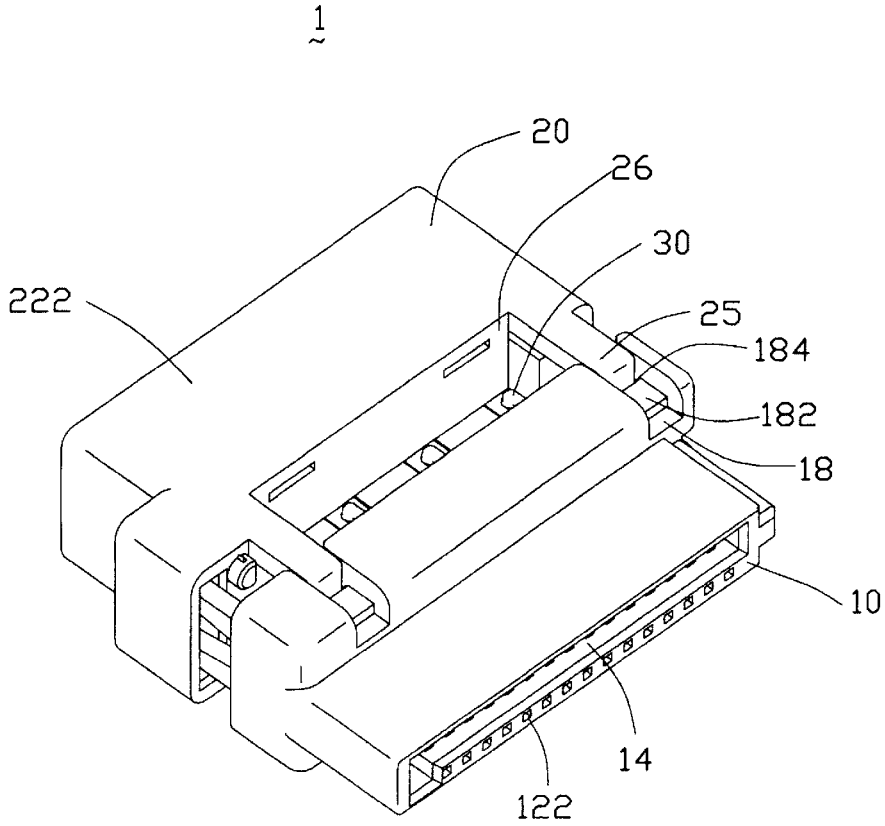
FIG. 2 is an initial assembled view of FIG. 1.

Reference will now be made to drawings, and particularly to FIG. 1, an electrical adapter 1 in accordance with the preferred embodiment of the present invention comprises a first connector portion 10, a second connector portion 20 and a plurality of flexible wires 30 electrically connecting the first and second connector portions 10, 20 with each other. The first connector portion 10 is Serial ATA power receptacle connector for mating with a Serial ATA power plug connector (not shown). The second connector portion 20 is a conventional IDE plug power connector for engaging with a conventional IDE receptacle connector (not shown).

Figure 7:
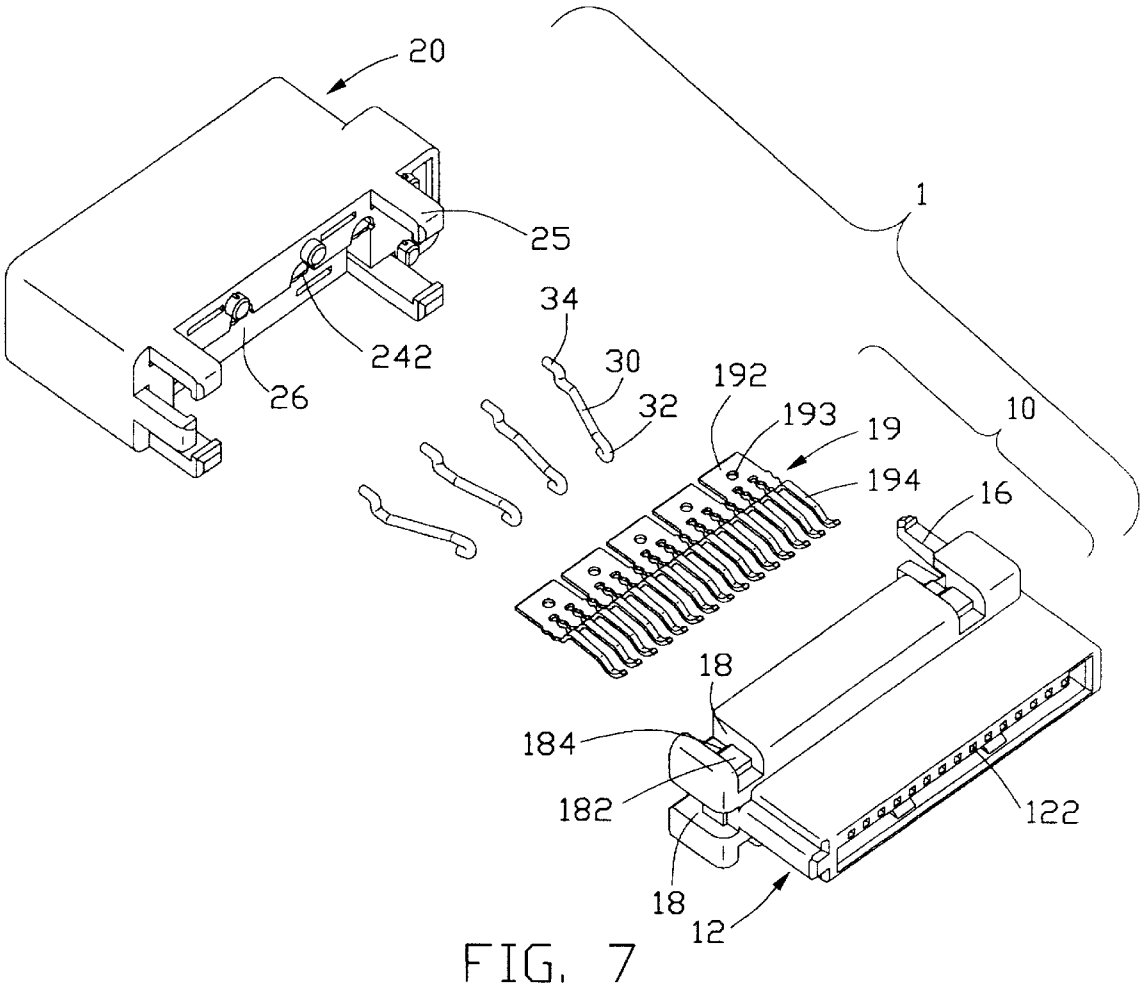
FIG. 7 is another exploded view of FIG. 1.
Figure 8:
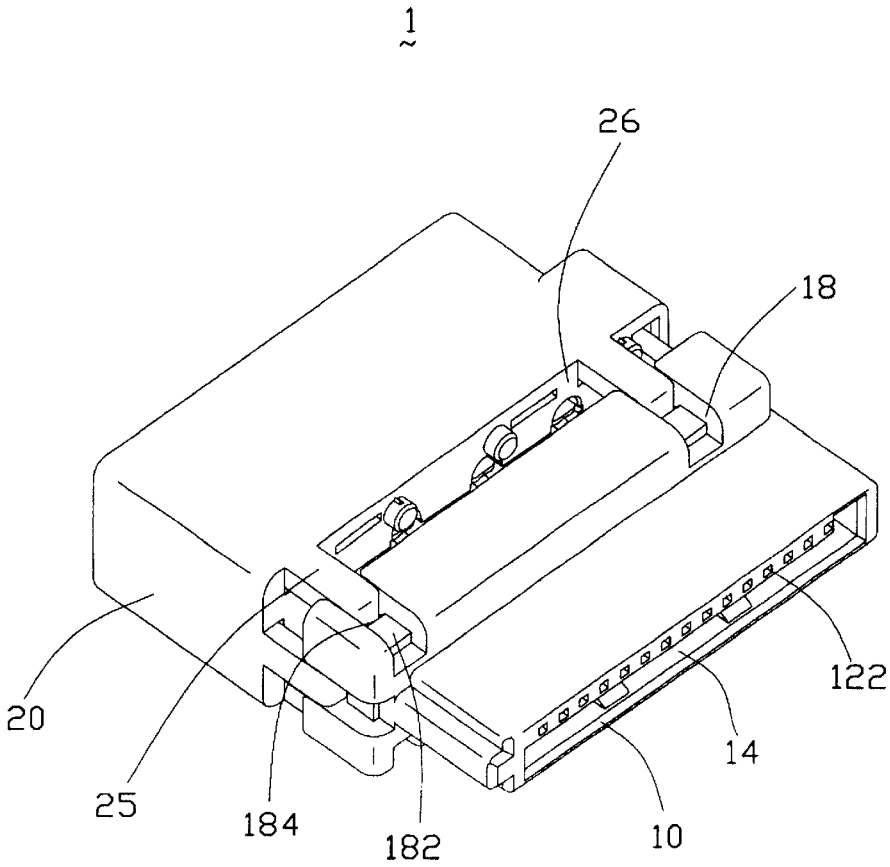
FIG. 8 is an initial assembled view of FIG. 7.
Figure 9:
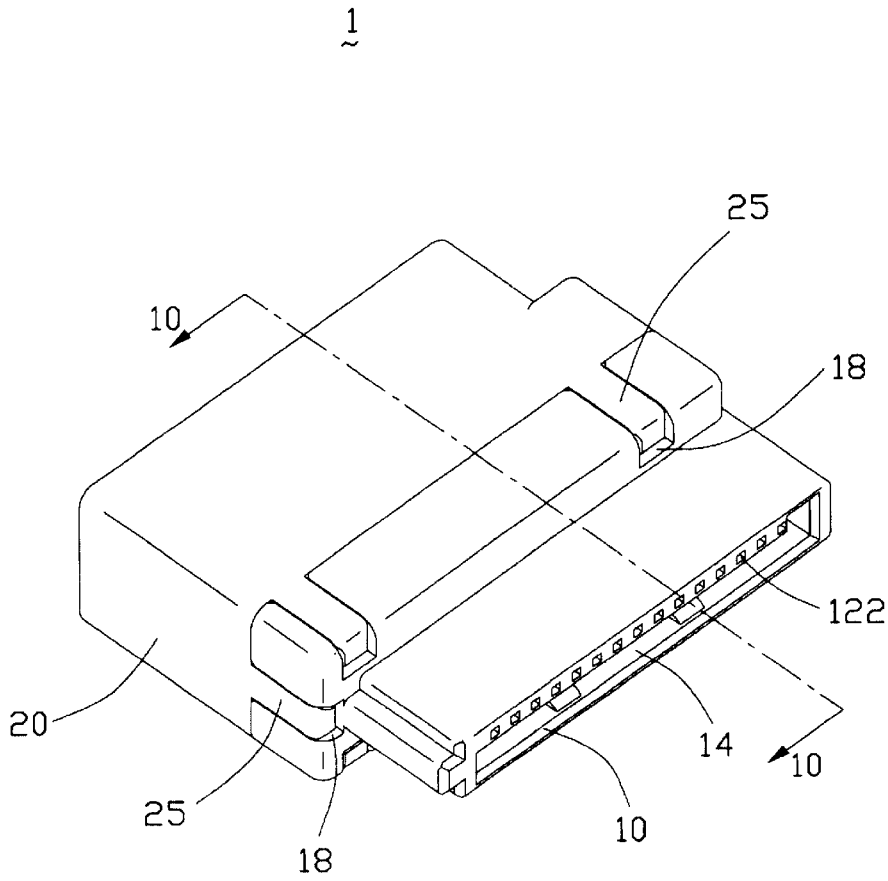
FIG. 9 is a final assembled view of FIG. 7.
Figure 10:
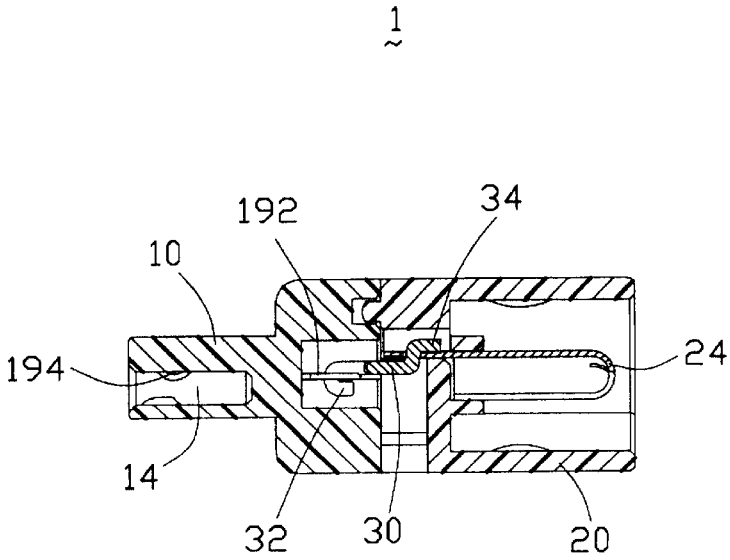
FIG. 10 is another initial assembled view of FIG. 7.
Figure 11:
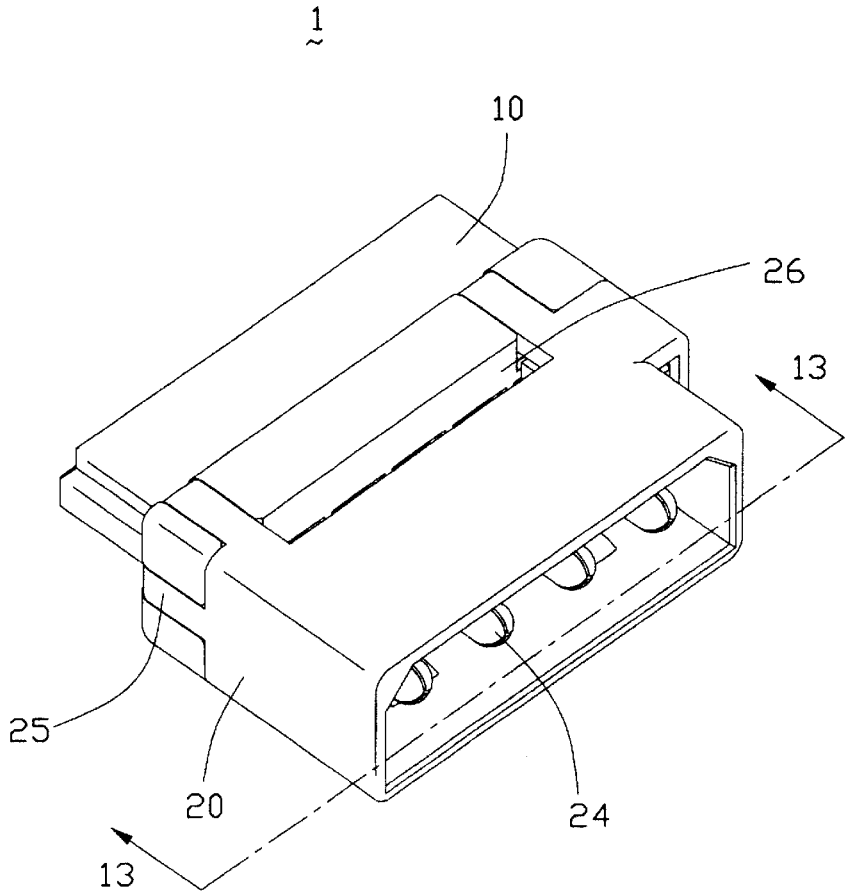
FIG. 11 is a top view of FIG. 10.
Figure 12:
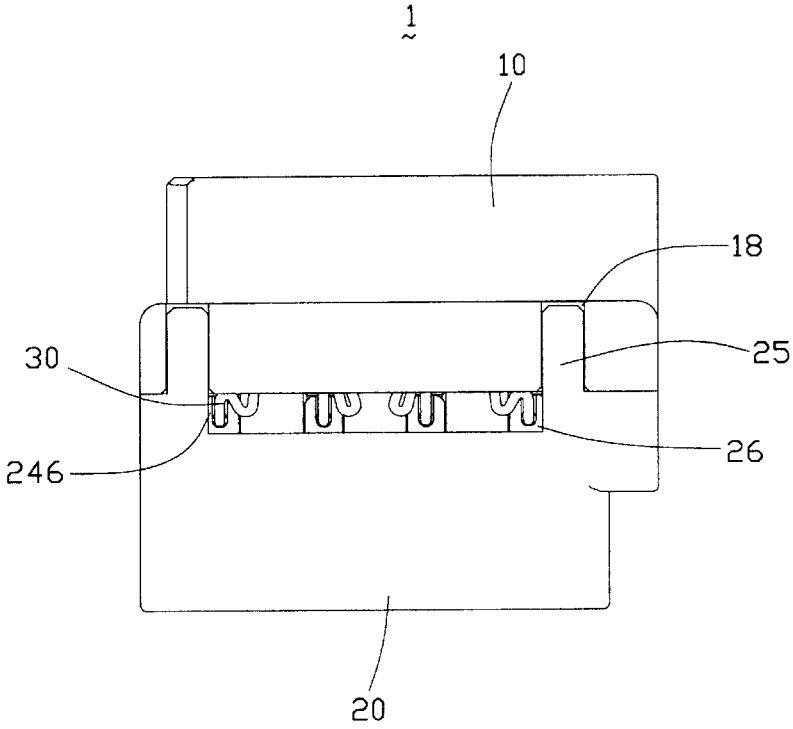
FIG. 12 is a cross-sectional view taken along line 12—12 of FIG. 10.

Further referring to FIG. 7, the first connector portion 10 is substantial same as that disclosed in the co-pending application, and thus, it is only summarily described hereinafter.

The first connector portion 10 includes a first dielectric housing 12 and a plurality of first power contacts 19 retained to the first dielectric housing 12. The first dielectric housing 12 defines a plurality of passageways 122 for receiving the first power contacts 19 and a chamber 14 opened in a rear face 13 of the first housing 12 and communicated with the passageways 122. A first latch member 16 projects from one lateral side of a front face 11 of the first dielectric housing 12. Additionally, two pairs of upper and lower receiving recesses 18 are defined in opposite top and bottom faces 15, 17 of the dielectric housing 12, and another receiving recess 18 is further defined in a lateral side of the first dielectric housing 12. A projection 182 is formed in each of the receiving recesses 18 and has a forward inclined surface 184 and a rearward vertical surface 186 opposite to the forward inclined surface 184. There are totally five first power contacts 19 in accordance with the preferred embodiment of the present invention. Each first power contact 19 has a body plate 192 defining a hole 193 and three mating tails 194 extending from the body plate 192 for insertion into corresponding passageways 122 of the first housing 12.

The second connector portion 20 is similar to that disclosed in the co-pending application, and thus, it is only emphasized in different features from the later.

The second connector portion 20 has a second dielectric housing 22 and four second power contacts 24 retained in the second dielectric housing 22. The second dielectric housing 22 defines an elongated opening 26 in a top surface 222 thereof and a receiving slot 23 in a rear surface 224 thereof to fit with the first latch member 16 of the first connector portion 10. Several second latch members 25 project rearward from the rear surface 224 for latching with corresponding receiving recesses 18 of the first connector portion 10. Each second power contact 24 has a solder end 242 communicated with the elongated opening 26. The solder end 242 defines a through hole 244 to provide strain relief function and an indent 246 communicated with the through hole 244 in a top face thereof.

There are totally four flexible wires 30 in accordance with the preferred embodiment of the present invention for electrically connecting the first and second power contacts 19, 24 together. Each flexible wire 30 has one end 32 going through and soldered to the hole 193 of a corresponding first power contact 19 and an opposite end 34 mounted into and soldered to the indent 246 of a corresponding second power contact 24.

Figure 3:
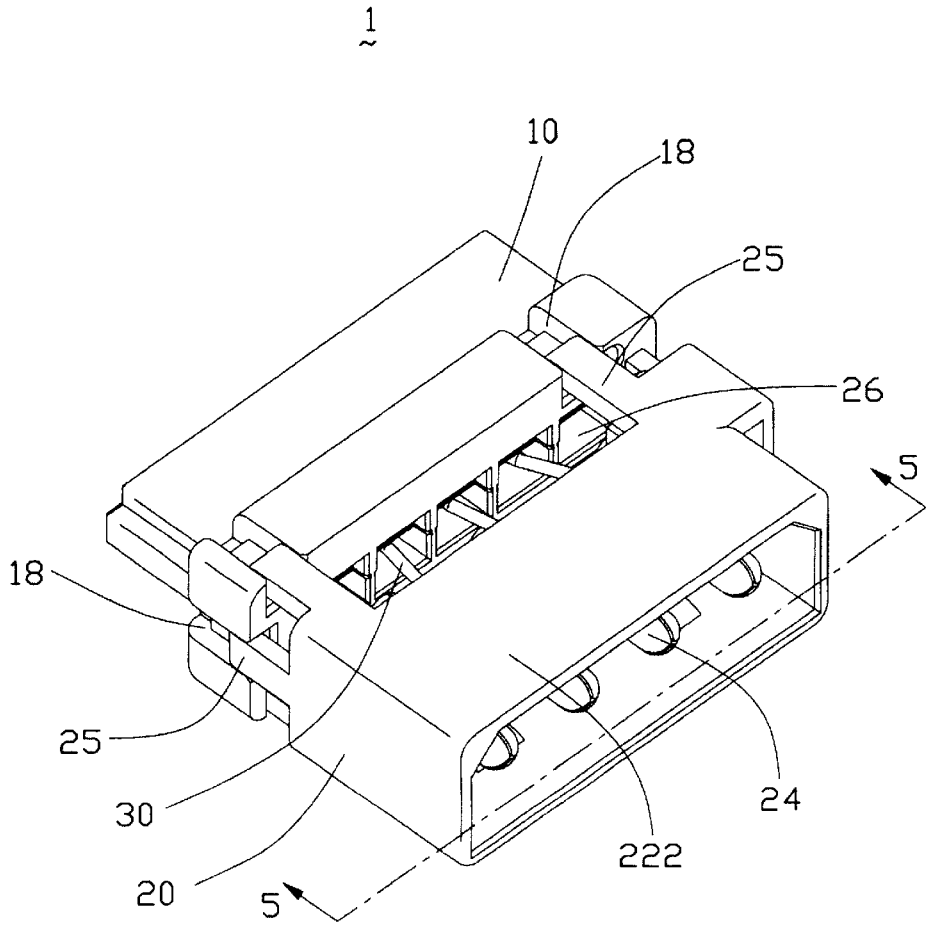
FIG. 3 is a final assembled view of FIG. 1.
Figure 4:
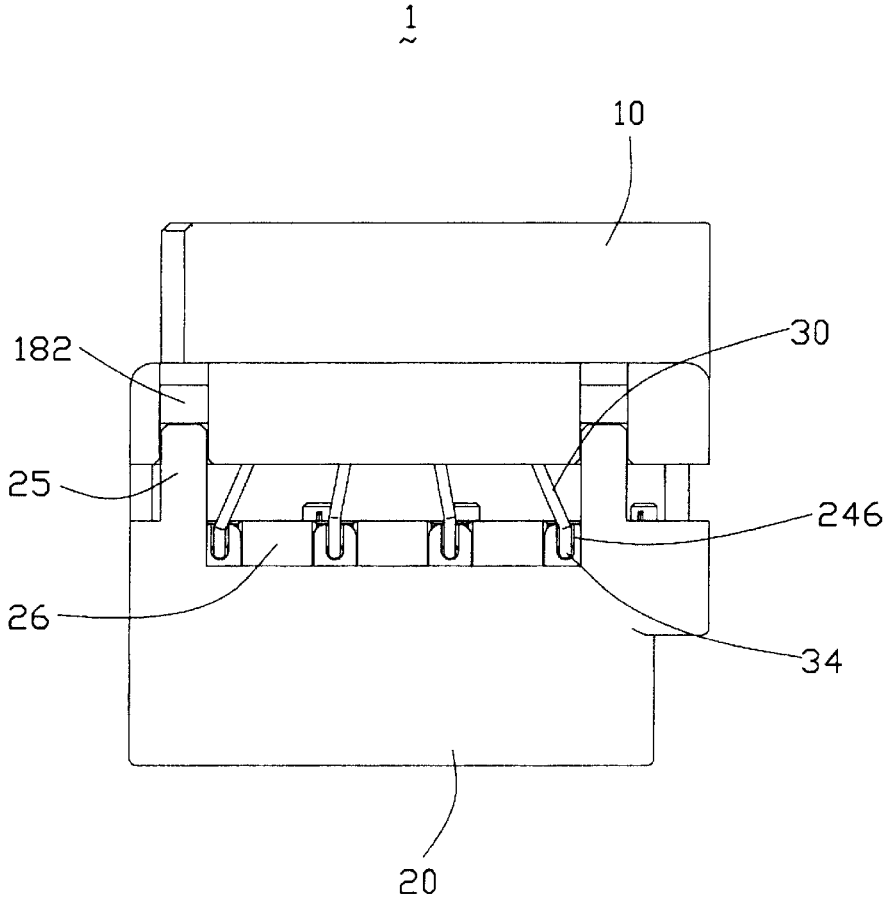
FIG. 4 is a top view of FIG. 3.
Figure 5:
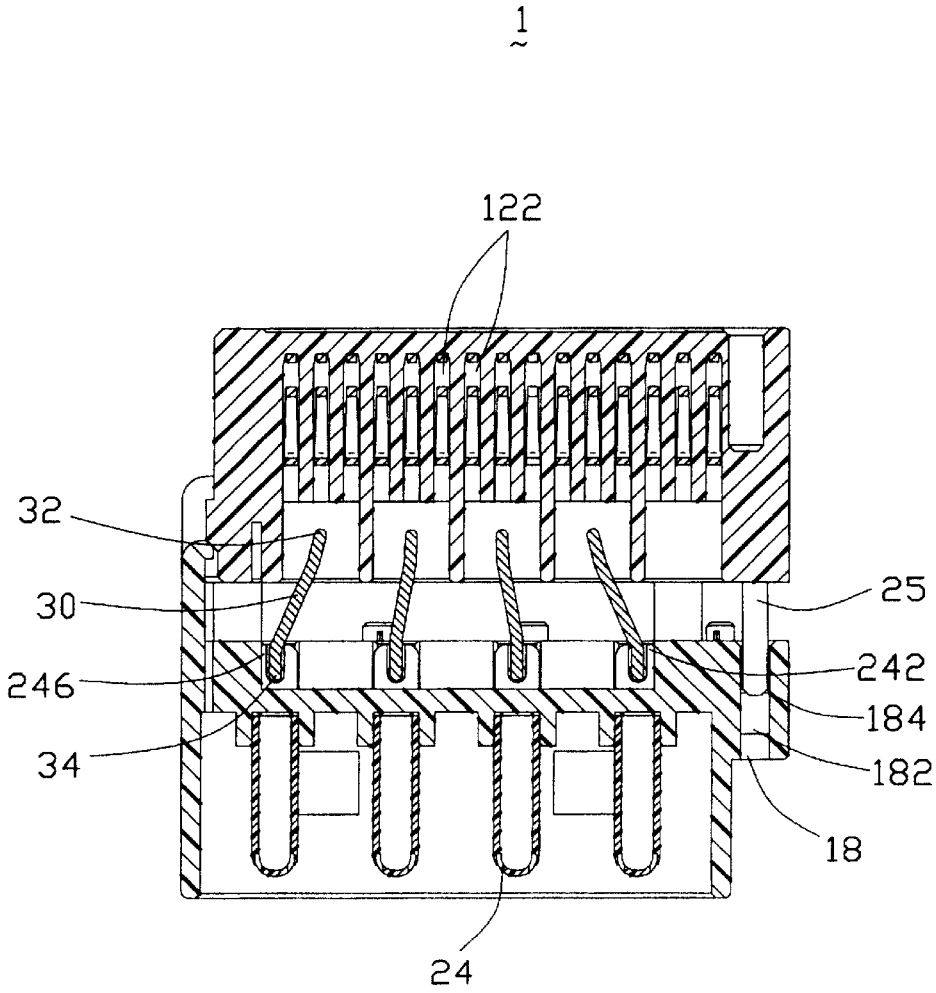
FIG. 5 is a cross-sectional view taken along line 5—5 of FIG. 4.
Figure 6:
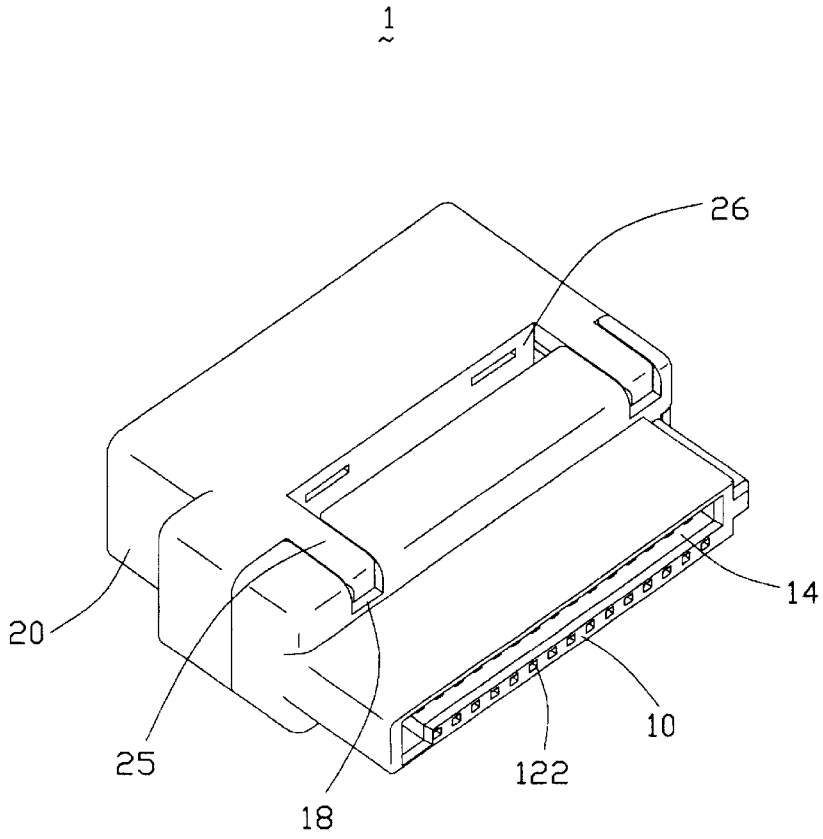
FIG. 6 is another final assembled view of FIG. 1.
Figure 13:
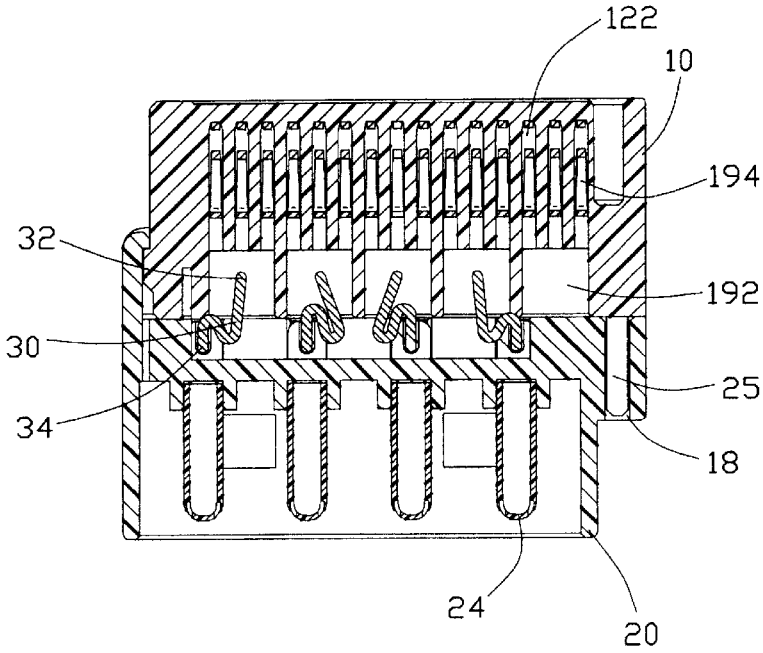
FIG. 13 is a cross-sectional view taken along line 13—13 of FIG. 10.

In assembly, referring to FIGS. 1 to 6, the first power contacts 19 are inserted into corresponding passageways 122 and the mating tails 194 thereof are partially projected into the chamber 14 for mating with a complementary terminal (not shown) of the Serial ATA receptacle connector (FIG. 13). Next, the flexible wires 30 are to be connected to the first power contacts 19. One first power contact 19 is redundant with respect to the four flexible wires 30 since five ones 19 are provided. That is, the ends 32 of the flexible wires 30 go through and are soldered to the holes 193 of four first power contacts 19 optionally selected from the five ones. The other ends 34 of the flexible wires 30 are then soldered to the indents 246 of the second power contacts 24. After the soldering process is securely finished, the first and second connector portions 10, 20 are beginning to mate with each other. The first and second latch members 16, 25 are aligned with and inserted into the receiving slot 23 and corresponding receiving recesses 18, respectively. At a position where the second latch members 25 are abutted against the inclined surfaces 184 of corresponding projections 182, each flexible wire 30 is tightened to be substantively shaped in a line, as best seen in FIGS. 3 to 5. Further referring to FIGS. 9 to 13, a final mated position of the first and second connector portions 10, 20 is obtained when the first latch member 16 is fully inserted into the receiving slot 23 of the second connector portion 20 and the second latch members 25 are snapped onto the vertical surfaces 186 of the corresponding projections 182. At this final mated position, the flexible wires 30 are become curved.

From the above description, it is easily understood that each flexible wire 30 can electrically connect an optional one of the second power contacts 24 to an optional one of the first power contacts 19, under the permission of the length and flexibility thereof. Thus, the electrical adapter 1 of the present invention provides an easy and optional electrical connection between first and second connector portions 10, 20 thereof by the flexible wires 30.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adapter comprising:

a first connector portion including a first dielectric housing and a plurality of first power contacts retained to the first dielectric housing;

a second connector portion including a second dielectric housing and a plurality of second power contacts retained to the second dielectric housing; and a plurality of flexible wires electrically connecting the first power contacts to the second power contacts; wherein each first power contact has a body plate defining a hole and several mating tails extending from the body plate for mating with a complementary connector; wherein each second power contact has a solder end which defines a through hole providing strain relief function and an indent in a top face thereof and communicated with the through hole; wherein one end of each flexible wire goes through and is soldered to the hole of the body plate of an optional one of the first power contacts, and another end of each flexible wire is soldered to the indent of an optional one of the second power contacts; wherein the second dielectric housing defines in a top face thereof an elongated opening communicated with the solder ends of the second power contacts for facilitating soldering; wherein the first dielectric housing defines several receiving recesses and forms a first latch member; wherein the second dielectric housing forms several second latch members engaged with the receiving recesses and defines a slot engaged with the first latch member; wherein a projection is formed in each receiving recess and has a forward inclined surface and a rearward vertical surface opposite to tie forward inclined surface.

2. The electrical adapter as claimed in claim 1, wherein the flexible wire is tightened and substantially shaped in a line at a position where the second latch member is abutted against the forward inclined surface of the projection, and is curved in an irregular shape at another position where the second latch member is snapped onto to the rearward vertical surface of the projection.

3. The electrical adapter as claimed in claim 1, wherein the first connector portion and the second connector portion have different types.

4. The electrical adapter as claimed in claim 1, wherein the first and second power contacts have different numbers.

5. The adapter as claimed in claim 1, wherein said flexible wires extend essentially in a diverging manner from the respective first power contacts to second power contacts.

6. The adapter as claimed in claim 1, wherein an amount of the first power contacts is more than that of the second power contacts, and thus at least one of the first power contacts has no flexible wires connected thereto.

7. The adapter as claimed in claim 1, wherein said first power contacts are smaller than the second power contacts.

8. The adapter as claimed in claim 1, wherein said flexible wires are deformable in a front-to-back direction of said adapter.

9. The adapter as claimed in claim 1, wherein two opposite end of each of the flexible wires are fixed to the corresponding first power contact and second power contact.

* * * * *